US005403654A

United States Patent [19]

Muto et al.

[11] Patent Number: 5,403,654

[45] Date of Patent: Apr. 4, 1995

[54] CHOPPED STRAND MAT AND THERMOPLASTIC SHEET

[75] Inventors: Akira Muto; Yoshihiro Yamana, both of Kurashiki; Isao Ohnishi, Okayama; Shigeru Yano; Mitsuo Nakazawa, both of Matsusaka, all of Japan

[73] Assignees: Kuraray Co., Ltd., Kurashiki; Central Glass Company, Limited, Ube, both of Japan

[21] Appl. No.: 219,420

[22] Filed: Mar. 29, 1994

Related U.S. Application Data

[63] Continuation of Ser. No. 44,078, Apr. 6, 1993, abandoned, which is a continuation of Ser. No. 915,767, Jul. 21, 1992, abandoned, which is a continuation of Ser. No. 440,110, Nov. 22, 1989, abandoned.

[30] Foreign Application Priority Data

Nov. 24, 1988 [JP] Japan ..... 63-297382

[51] Int. Cl.[6] ..... D04H 1/58; B32B 27/00; B32B 25/20

[52] U.S. Cl. ..... 428/288; 428/290; 428/378; 428/391; 428/902

[58] Field of Search ..... 428/378, 375, 391, 290, 428/288, 902

[56] References Cited

U.S. PATENT DOCUMENTS

| | | | |
|---|---|---|---|
| 4,098,943 | 7/1978 | Degginger et al. | 428/284 |
| 4,240,944 | 12/1980 | Temple | 428/391 |
| 4,271,229 | 6/1981 | Temple | 428/391 |
| 4,283,322 | 8/1981 | Temple | 428/391 |
| 4,301,052 | 11/1981 | Pollman | 428/378 |
| 4,410,645 | 10/1983 | Das et al. | 428/391 |
| 4,433,020 | 2/1984 | Narukawa et al. | 428/288 |
| 4,434,521 | 3/1984 | Martin et al. | 428/290 |
| 4,435,474 | 3/1984 | Das et al. | 428/391 |
| 4,596,736 | 6/1986 | Eichhorn et al. | 428/284 |
| 4,659,753 | 4/1987 | Tiburtius et al. | 428/378 |
| 4,728,573 | 3/1988 | Temple | 428/378 |
| 4,762,750 | 8/1988 | Girgis et al. | 428/378 |
| 4,762,751 | 8/1988 | Girgis et al. | 428/378 |
| 4,789,593 | 12/1988 | Das | 428/378 |

*Primary Examiner*—James D. Withers

*Attorney, Agent, or Firm*—Oblon, Spivak, McClelland, Maier, & Neustadt

[57] ABSTRACT

This invention relates to a chopped strand mat and a thermoplastic sheet for the manufacture of molded articles which are excellent in strength, rigidity and impact resistance as well as in color quality.

The chopped strand mat according to the invention comprises chopped strands having fiber lengths of 10 to 100 mm and doped with a surface treating composition comprising an expoxysilane coupling agent and an epoxy resin and, as a binder, a polymer containing an acrylic ester unit. The thermoplastic sheet according to the present invention comprises the chopped strand mat impregnated with a thermoplastic resin.

10 Claims, No Drawings

CHOPPED STRAND MAT AND THERMOPLASTIC SHEET

This application is a continuation of application Ser. No. 08/044,078, filed on Apr. 6, 1993, now abandoned, which was a continuation of Ser. No. 07/915,767, filed on Jul. 21, 1992, also abandoned, which was a continuation of Ser. No. 07/440,110, filed on Nov. 22, 1989 also abandoned.

BACKGROUND OF THE INVENTION

The present invention relates to a chopped strand mat and a thermoplastic sheet, both of which are suited for the production of molded articles having improved strength, rigidity and impact resistance as well as attractive colors.

The glass fiber-reinforced thermoplastic resin is generally manufactured by adding short glass fibers to a thermoplastic resin (hereinafter referred to briefly as TP) and melt-compounding them to achieve a uniform dispersion of glass fibers in the TP. Shaped articles manufactured from the resulting compound by injection-molding are used widely as electric/electronic parts, automotive components and so on. However, since those injection-molded articles have anisotropy in strength and are inadequate in impact resistance, they have not been used as structural parts. Intended to obviate these disadvantages, the thermoplastic sheet manufactured by laying up TP and an isotropic glass fiber mat and pressing the combination under heating have been proposed in Japanese Patent Publication No. 54-36193 and Japanese Kokai Patent Publication No. 55-152058. The production of such sheet essentially requires a step of holding the glass fiber mat and TP at a temperature not lower than the melting point or softening point of the TP in order that the glass fiber mat may be sufficiently impregnated with the TP.

On the other hand, processes for the manufacture of molded articles which comprise heating such a sheet at a temperature which is higher than the melting point or softening point of the TP but lower than its decomposition point and press-molding the same in a matched metal mold held at a temperature below said melting point or softening point (the so-called stamp-molding technique) were proposed in Japanese Patent Publication No. 58-34292 and Japanese Kokai Patent Publication No. 62-92831.

For the production of structural parts, not only high strength and rigidity requirements but also a high heat resistance requirement must be fulfilled. From these considerations, in the heating and compression stage in the manufacturing process for a composite thermoplastic sheet using a glass fiber mat and TP, a high temperature of not less than 200° C. is generally applied. Furthermore, in the step-molding stage in the production of molded articles from a thermoplastic sheet, the sheet is more often than not subjected to a temperature over 200° C.

However, when a high temperature not lower than 200° C. is used in the manufacture of a thermoplastic sheet or in the stamp-molding process, the glass fiber segments are usually discolored by heat. For example, the thermoplastic sheet incorporating a chopped strand mat, which is generally employed for the manufacture of fiber-reinforced plastic products by the hand layup technique (the glass chopped strand mat fibricated using an unsaturated alkyd resin as the binder) and any molded article manufactured by the stamp-molding of such thermoplastic sheet have generally been exposed to high temperatures over 200° C. As a result, both the thermoplastic sheet and the finished article betray yellow-brown discoloration along the glass fibers, thus detracting from the surface appearance of the products. Moreover, even in the production of colored articles, the above-mentioned discoloration causes a distinct demarcation between the area where the glass fiber is present and the adjacent area so that the overall appearance of the article is made unsettled, thus detracting from the market value of the product. The degree of this discoloration tends to be higher when the treating temperature is higher and/or the treatment time is prolonged.

When a chopped strand mat of wholly-aromatic polyester fiber is used, too, the treatment is carried out at a temperature not lower than 200° C. and, consequently, the polyester fiber is discolored. Therefore, the stamp-molded article from the mat presents a generally dull unsettled appearance, thus detracting from its aesthetic quality. The chopped strand mat of carbon fiber is also heat-treated at a temperature over 200° C., so that the areas along the fibers are similarly discolored and the final article is also poor in appearance.

SUMMARY OF THE INVENTION

It is an object of the present invention to provide a chopped strand mat and a thermoplastic sheet, which are suited to the manufacture of molded articles which are excellent in strength, rigidity and impact resistance as well as in color quality.

Other objects and advantages of the present invention will become apparent from the following description.

The chopped strand mat according to the present invention comprises chopped strands having fiber lengths of 10 to 100 mm and doped with a surface treating composition comprising an epoxysilane coupling agent and an epoxy resin, and as a mat binder, a polymer containing an acrylic ester unit. The thermoplastic sheet according to the present invention comprises said chopped strand mat impregnated with a thermoplastic resin.

DETAILED DESCRIPTION OF THE PREFERRED EMBODIMENTS

The length of the chopped strand constituting the chopped strand mat is generally 10 to 100 mm and preferably 12.5 to 75 mm. If the length of each chopped strand is less than 10 mm, it is sometimes difficult to form a chopped strand mat and, moreover, the resulting mat is deficient in dimensional stability. Furthermore, the thermoplastic sheet obtainable from such a chopped strand mat is inadequate in strength and impact resistance. If the length of chopped strand exceeds 100 mm, the thermoplastic sheet based on such chopped strand mat does not provide a satisfactory molded article because the intricate parts of the article, such as ribs and bosses, are not evenly filled up with reinforcing fibers. While the diameter of fibers constituting the chopped strand is not critical, it is preferably in the range of 6 to 30 μm. From the standpoints of the strength characteristic of thermoplastic sheet, the surface smoothness of molded articles and the economics of production, the fiber diameter is more desirably in the range of 9 to 25 μm. While there is no critical limit to the number of fibers constituting each individual chopped strand, it is preferably in the range of 10 to 400 and more desirably in the range of 20 to 200. Though it depends on fiber diameter, the impregnation of the chopped strand mat with TP is not thorough when the number of fibers per strand is not more than 9. On the other hand, if the number of fibers per strand exceeds 400, the strands tend to rise over the surface of the molded article molded from a thermoplastic sheet containing such chopped strand mat. Thus, both a deficiency and an excess of fibers are undesirable.

The chopped strand constituting the chopped strand mat of the present invention is formed from glass fiber, wholly-aromatic polyester fiber, carbon fiber or the like. These fibers can be used singly or in combination. Particularly preferred is glass fiber.

In the formation of strands, a surface treating agent is applied in the form of an aqueous emulsion. The surface treating composition to be used in the present invention comprises an epoxysilane coupling agent, such as β-(3,4-epoxycyclohexyl)ethyltrimethoxysilane, γ-glycidoxypropyltrimethoxysilane, etc., and as a film-forming component, an epoxy resin. The preferred epoxysilane coupling agent is γ-glycidoxypropyltrimethoxysilane. It should be understood that the surface treating composition may further contain various additives such as a lubricating agent, anti-static agent and so on.

The epoxy resin used as the film-forming component mentioned above includes, among others, bisphenol type epoxy resin, novolak epoxy resin and alicyclic epoxy resin. Each of these epoxy resins is commercially available in the form of aqueous emulsions. Thus, as commercial aqueous emulsions of bisphenol type liquid epoxy resin, there may be mentioned EPOLSION EA-1 (Kanebo NSC, Ltd.) and YUKARESIN KE-002 (Yoshimura Oil Chemical Co., Ltd.). Among the commercial aqueous emulsions of bisphenol type solid epoxy resin are EPOLSION EA-3 (Kanebo NSC, Ltd.) and YUKARESIN E-200 (Yoshimura Oil and Chemicals Co., Ltd.). In the present invention, such aqueous epoxy resin emulsions can be used independently or in combination.

The proportion of the epoxysilane coupling agent in the surface treating composition is preferably in the range of 0.05 to 2.0 weight percent and more desirably in the range of 0.1 to 1.0 weight percent. If the proportion of the epoxysilane coupling agent is less than 0.05 weight percent, the strength of the shaped article is seriously sacrified, while the use of this agent in a proportion of more than 2.0 weight percent is uneconomical because of saturation of molded strength.

The proportion of the aqueous epoxy resin emulsion relative to the total surface treating composition cannot be stated in definite terms when a commercial epoxy resin emulsion is utilized, for commercial emulsions vary in resin concentration. However, it should be insured that the amount of epoxy resin deposited on the strand will be in the range of 0.5 to 2 weight percent and preferably within the range of 0.3 to 1.2 weight percent. If the proportion of the epoxy resin is less than 0.2 weight percent, it becomes difficult to bind the fibers. On the other hand, if the epoxy resin is used in excess of 2 weight percent, the bindability of the fibers may be too great to assure a sufficient impregnation with TP.

The chopped strand mat according to the present invention is manufactured by cutting the above strand to a predetermined length (formation of chopped strands), laying down individual chopped strands in a random pattern (without orientation) and forming them into a mat, and applying a mat binder (known as the secondary binder) to keep the integrity of the mat.

The weight of the mat formed with chopped strands is preferably in the range of 300 to 5000 g/m$^2$ and, in view of the ease of handling and resin impregnatability, more desirably in the range of 350 to 1500 g/m$^2$.

In the present invention, a polymer containing an acrylic ester unit is used as the mat binder. The terms "acrylic ester" mean both acrylic acid esters and methacrylic acid esters. When the ester moiety of such an ester is expressed by —COOR, R includes, among others, $C_{1-18}$ or β-hydroxyalkyl and glycidyl, and as examples of said alkyl or β-hydroxyalkyl, there may be mentioned methyl, ethyl, propyl, butyl, hexyl, cyclohexyl, heptyl, octyl, nonyl, decyl, dodecyl, stearyl, β-hydroxyethyl, β-hydroxypropyl, β-hydroxybutyl and so on.

The polymer containing an acrylic ester unit is a homopolymer or copolymer which is, as aforesaid, obtainable from at least one monomer selected from the group consisting of acrylic acid esters and methacrylic acid esters and preferably a terpolymer comprising an acrylic acid ester, glycidyl methacrylate and a methacrylic acid ester other than glycidyl methacrylate. The preferred composition is: 3 to 70 weight percent of acrylic acid ester, 3 to 40 weight percent of glycidyl methacrylate and 1 to 70 weight percent of methacrylic acid ester other than glycidyl methacrylate. From the standpoints of physical properties and color tone, the more desirable proportions of these comonomers are 5 to 60 weight percent, 5 to 30 weight percent, and 2 to 60 weight percent, respectively.

The above polymer can be produced by a known technology, such as emulsion polymerization, suspension polymerization, solution polymerization and so on.

The polymer may further be a copolymer of said (meth)acrylic acid ester or esters with not more than 20 weight percent of other monomers such as styrene, acrylonitrile and so on.

The polymer containing such an acrylic ester has a softening point of generally 50° to 200° C. and preferably 70° to 150° C. If the softening point is lower than 50° C., blocking tends to occur to seriously interfere with the production of chopped strand mats. On the other hand, if the softening point of the polymer exceeds 200° C., it will not be fully molten and the retention stability of the chopped strand mat be adversely affected.

The amount of the mat binder to be deposited on the chopped strand mat need not be larger than the minimum required for the shape retention of the mat and, as such, is preferably about 0.5 to 10 weight percent and more desirably about 1.0 to 6.0 weight percent. If the amount of the mat binder is less than 0.5 weight percent, the integrity of the mat is adversely affected, while the use of the binder in excess of 10 weight percent results in insufficient TP impregnation so that the moldability of the thermoplastic sheet is adversely affected.

The thermoplastic sheet of the present invention is a composite sheet made up of the chopped strand mat obtained as above and a thermoplastic resin and the proportion of the chopped strand mat in the thermoplastic sheet as a whole is preferably in the range of about 15 to 60 weight percent and, for still better results, in the range of about 20 to 50 weight percent. If the proportion of the chopped strand mat is less than 15 weight percent, the strength and impact resistance of shaped articles will not be as high as desired. On the other hand, if the proportion of the mat exceeds 60 weight percent, both moldability and surface smoothness will be sacrificed.

The thermoplastic resin which can be employed in the present invention includes, among others, polyolefin resins such as polypropylene, etc., polyamide resins such as nylon-6, nylon-66, nylon-12, etc., polyester resins such as polyethylene terephthalate, polybutylene terephthalate, etc., polyethersulphone resins, polycarbonate resins and so on.

When the chopped strand is made of glass or carbon fiber, it is preferable to use a polyester, polyamide or polycarbonate resin which melts at a comparatively high temperature over 220° C. as the thermoplastic resin. When the chopped strand mat is composed, either solely or in part, of wholly-aromatic polyester fiber, it is preferable to use a thermoplastic resin having a melting or softening point lower than the melting point of said wholly-aromatic polyester fiber, such as polypropylene resin.

These resins may be used as such or as modified. Moreover, two or more of these resins may be used as a blend. For the purpose of imparting various custom characteristics, it is possible to add various additives such as an antioxidant, thermal stabilizer, ultraviolet absorber, flame retardant, mold release, lubricant, antistatic agent, color, reinforcers/fillers such as mica and talc.

The TP to be used in accordance with the present invention includes such various forms as sheet, granules, pellets, powder, molten resin and so on and two or more of such different forms may be used in combination. All that is necessary that TP is used in forms facilitating impregnation of the chopped strand mat.

The thermoplastic sheet according to the present invention can be easily manufactured by any of the per se known techniques, for example by means of a matched steel double belt press. For the manufacture of molded articles using this thermoplastic sheet, the conventional stamp-molding technique or any modification thereof can be advantageously utilized.

With the chopped strand mat and thermoplastic sheet of the present invention, a variety of molded articles having excellent strength, rigidity and impact resistance characteristics and, in addition, improved colors, can be manufactured.

The following Examples and Comparative Examples are intended to illustrate the invention in further detail and should by no means be construed as defining the scope of the invention.

In the Examples and Comparative Examples, various characteristics were measured by the following methods.

(1) Physical Properties

Tensile strength, flexural strength, flexural modulus and notched Izod impact strength were all measured in accordance with JIS K-6911.

(2) Thermal Discoloration i) Thermal Discoloration of the Chopped Strand Mat

Samples of the chopped strand mat were heat-treated for 10 minutes at the temperature set for impregnation of TP or the temperature set for melting the TP in stamp-molding (both temperatures were over 200° C.) and the color of each sample was compared with that of the control mat sample not subjected to the heat treatment.

ii) Thermal Discoloration of the Shaped Article

The pigment-free thermoplastic sheet was stamp-molded to prepare a board and testpieces (50×50 mm) were cut out. Using Hitachi Color Analyzer 307, the three stimulus values (X, Y and Z) of each testpiece were measured by the reflection method according to JIS K-7103, Methods for Testing the Yellowness and Degree of Yellowing of Plastics. From the three stimulus values (X, Y and Z), the yellowness index (Y.I) was calculated by means of the following equation.

$$Y \cdot I = \frac{100(1.28X - 1.06Z)}{Y}$$

Y.I: yellowness index

X, Y and Z: the three stimulus values of a testpiece as measured with the standard light source C.

The larger the Y.I value thus determined, the greater is the yellowness of the testpiece.

For the evaluation of colored articles, the thermoplastic resin SMC was stamp-molded and the article was macroscopically evaluated. The result of evaluation was compared with the result for the article obtained from the pigment free-sheet.

Example 1

Eighty 13-μm glass filaments extruded from a platinum bushing were sprayed with a surface treating composition containing 0.5 weight % of γ-glycidoxypropyltrimethoxysilane (A-187, NIPPON UNICAR Co.), 6.0 weight % of an aqueous epoxy resin emulsion (EPOLSION EA-3, Kanebo NSC) and 93.5 weight % of water and were bundled into a strand. The strand roving was taken up in the shape of a cake and dried at 125° C. for 10 hours. The deposition amount of the surface treating composition was 0.5 weight %. The roving was cut to 50 mm lengths and the resulting chopped strand was randomly laid out and formed into a mat weighing 450 g/m$^2$. As a mat binder, a microfine powdery copolymer consisting of 15 wt. % of glycidyl methacrylate, 35 wt. % of methyl methacrylate, 40 wt. % of butyl acrylate and 10 wt. % of styrene and having a softening point of 107° C. and a number average molecular weight of 8,300 was applied to the mat in a proportion of 2.5 wt. % and the treated mat was heated at 200° C. to melt the binder to give a chopped strand mat (A) which was able to be easy to handle.

Example 2

The procedure of Example 1 was repeated except that, as mat binder, polymethyl methacrylate was applied in a proportion of 2.5 wt. % to give a chopped strand mat (B). The strand-to-strand bond strength of this mat (B) was slightly inferior to that of the mat (A) of Example 1 but practically no problem was found.

Example 3

The procedure of Example 1 was repeated except that, as mat binder, polybutyl acrylate was applied in a proportion of 2.5 wt. % to prepare a chopped strand mat (C). The strand-to-strand bond strength of this mat (C) was slightly inferior to that of the mat (A) of Example 1 but practically no problem was found.

Example 4

The procedure of Example 1 was repeated except that, as mat binder, a methyl methacrylate (50 wt. %-butyl acrylate (50 wt. %) copolymer was used in a proportion of 2.5 wt. % to give a chopped strand mat (D). The strand-to-strand bond strength of this mat (D) was slightly inferior to that of the mat (A) of Example 1 but practically no problem was found.

Example 5

The procedure of Example 1 was repeated except that, as mat binder, a methyl methacrylate (40 wt. %-butyl acrylate (45 wt. %)-glycidyl methacrylate (15 wt. %) terpolymer was used in a proportion of 2.5 wt. % to give a chopped strand mat (E). The strand-to-strand bond strength of this mat (E) was slightly inferior to that of the mat (A) of Example 1 but practically no problem was found.

Example 6

The procedure of Example 1 was repeated except that wholly-aromatic polyester filaments having a diameter of 23 μm (Vectran, Kuraray) were used in lieu of said 13 μm glass filaments to prepare a strand. The strand roving was cut to 50 mm lengths. This chopped strand and the glass chopped strand prepared in Example 1 were randomly laid out in a weight ratio of 1:1 and formed into a mat weighing 400 g/m$^2$ and the same mat binder as used in Example 1 was applied in a proportion of 2.5 wt. % to give a mat (F).

Example 7

Eighty carbon filaments obtained by infusiblization and subsequent carbonization of pitch fibers extruded by the melt-spinning technique were sprayed with the same surface treating composition as used in Example 1 to give a strand. This strand was cut to 50 mm lengths. The resulting chopped strand and the same glass chopped strand as prepared in Example 1 were randomly laid out in a weight ratio of 1:1 and formed into a mat weighing 400 g/m$^2$. To this mat was applied 2.5 wt. % of the same mat binder as used in Example 1 to give a mat (G).

Comparative Example 1

The procedure of Example 1 was repeated except that γ-methacryloxypropyltrimethoxysilane (A-174, Nippon Unicar Co.) was used as the coupling agent to give a chopped strand mat (H).

Comparative Example 2

The procedure of Example 1 was repeated except that A-174 (See Comparative Example 1) was used as the coupling agent and a polyvinyl acetate emulsion (YODOSOL LD1010, Kanebo NSC) as the film-forming component to give a chopped strand mat (I).

Comparative Example 3

The procedure of Example 1 was repeated except that A-174 and said polyvinyl acetate emulsion (See Comparative Example 2) were used as the coupling agent and film-forming component, respectively, and a microfine unsaturated alkyd resin powder (CHEMITYLEN PEB-13, Sanyo Chemical Industries) was used as the mat binder to give a chopped strand mat (J).

Comparative Example 4

The procedure of Example 1 was repeated except that the microfine unsaturated alkyd resin powder mentioned in Comparative Example 3 was used as the mat binder to give a chopped strand mat (K).

Comparative Example 5

The procedure of Example 1 was repeated except that a microfine epoxy resin powder (EPIKOTE 1004, Shell Chemical) was used as the mat binder to give a chopped strand mat (L).

Comparative Example 6

The procedure of Example 1 was repeated except that said γ-glycydoxypropyltrimethoxysilane (A-187) (0.25 wt. %) and aminopropyltriethoxysilane (A-1100, Nippon Unicar Co.) (0.25 wt. %) were used in combination as the coupling agent and said epoxy resin emulsion (EPOLSION EA-3) (3.0 wt. %) and a polyurethane emulsion (IMPRANIL DLS, Sumitomo-Bayer Japan) (3.0 wt. %) were used in combination as the film-forming component to give a chopped strand mat (M).

Comparative Example 7

A chopped strand mat (N) was prepared by the same procedure as Example 1 except that A-187 and A-1100, both mentioned in Comparative Example 6, were used as the coupling agent and the epoxy resin and polyurethane emulsions mentioned in Comparative Example 6 were used as film-forming agent, and the microfine unsaturated alkyd resin powder mentioned in Comparative Example 3 was used as the mat binder.

The chopped strand mats (A) through (N) prepared in Examples 1 through 7 and Comparative Examples 1 through 7 were respectively heat-treated at 220° C. for minutes at 285° C. for 10 minutes and at 350° C. for a further 10 minutes and the colors of each chopped strand mat before and after the heat treatment were macroscopically examined and compared. The results are shown in Table 1.

TABLE 1

| | Mat | 220° C. × 10 min. | 285° C. × 10 min. | 350° C. × 10 min. |
|---|---|---|---|---|
| Example 1 | A | ◎ | ◎~Δ | ○ |
| Example 2 | B | ◎ | ◎~Δ | ○ |
| Example 3 | C | ◎ | ◎~Δ | ○ |
| Example 4 | D | ◎ | ◎~Δ | ○ |
| Example 5 | E | ◎ | ◎~Δ | ○ |
| Example 6 | F | ◎ | ○~Δ | — |
| Example 7 | G | ◎ | ◎~Δ | ○ |
| Comparative Example 1 | H | ○ | ○~Δ | Δ |
| Comparative Example 2 | I | ○~Δ | Δ | Δ~x |
| Comparative Example 3 | J | Δ | x | x |
| Comparative Example 4 | K | Δ | Δ | x |
| Comparative Example 5 | L | Δ | x | x |
| Comparative Example 6 | M | Δ | Δ~x | x |
| Comparative Example 7 | N | Δ | Δ~x | x |

Degree of discoloration
◎: None
○: Very slight
Δ: Slight
x: Dark

Example 8

The chopped strand mat (A) prepared in Example 1 and a pigment-free 0.8 mm-thick polyethylene terephthalate resin sheet containing an antioxidant and a thermal stabilizer were laid out in a weight ratio of 40:60 and fed into the clearance of a steel double belt press and heated at a temperature of 285° C. as measured in the center in thickness direction of the laminate to thereby melt the resin, while the laminate was compressed by roll means disposed externally of the respective belts. The procedure gave a 3.9 mm-thick polyethylene terephthalate sheet comprising an integral polyethylene terephthalate resin-chopped strand mat.

This sheet was cut to 85×175 mm and melted by heating with a far infrared heater at 300° C. for 7 minutes and promptly transferred into a matched metal mold having an internal volume of 100×200 mm and held at 160° C. The melt was stamp-molded at a pressure of 150 kg/cm$^2$ for a pressure hold time of 30 seconds to give a flat board having a thickness of about 3 mm.

Testpieces conforming to JIS K-6911 were cut out from the above board and submitted to physical tests. For evaluation of the degree of discoloration due to the heat applied in the course of preparation of the sheet molding compound and in the stamp-molding process, 50×50 mm testpieces were cut out from the board and the yellowness index (Y.I) was determined using the color analyzer described hereinbefore. The evaluation results are set forth in Table 2.

Example 9

The chopped strand mat (A) prepared in Example 1 and a pigment-free 0.75 mm-thick polypropylene resin sheet were laid out in a weight ratio of 40:60 and fed into the clearance of a matched steel double belt press and heated at a temperature of 220° C. as measured in the center in thickness direction of the laminate to thereby melt the resin, while the laminate was compressed by roll means disposed externally of the respective belts. The procedure gave a 3.7 mm-thick polypropylene sheet comprising an integral polypropylene resin chopped strand mat.

This sheet was cut to 85×175 mm and melted by heating with a far infrared heater at 230° C. for 7 minutes and promptly transferred into a matched metal mold having an internal volume of 100×200 mm and held at 30° C. In the same manner as Example 8, the melt was stamp-molded to give a flat board having a thickness of about 3 mm.

This board was evaluated as in Example 8. The results are shown in Table 2.

Example 10

The chopped strand mat (A) prepared in Example 1 and a 0.2 mm-thick commercial polyethersulfone resin sheet (TALPA-1000, Mitsui Toatsu Chemicals) were laid out in a weight ratio of 40:60 and fed into the clearance of a steel double belt press and heated at a temperature of 350° C. as measured in the center in thickness direction of the laminate to thereby melt the resin, while the laminate was compressed by roll means disposed externally of the respective belts. The procedure gave a 2 mm-thick polyethersulphone sheet comprising an integral polyethersulphone resin-chopped strand mat.

This sheet was cut to 85×175 mm and melted by heating with a far infrared heater at 370° C. for 7 minutes and promptly transferred into a matched metal mold having an internal volume of 100×200 mm and held at 130° C. Then, as in Example 8, the melt was stamp-molded to give a flat board having a thickness of about 3 mm.

The board was evaluated as in Example 8. The results are shown in Table 2.

Examples 11 to 14

Stamp-molded boards were prepared in the same manner as Example 8 except that chopped strand mats (B) (Example 11), (C) (Example 12), (D) (Example 13) and (E) (Example 14) were respectively used in lieu of chopped strand mat (A). These boards were evaluated as described hereinbefore. The results are shown in Table 2.

Example 15

A board was prepared by stamp-molding in the same manner as Example 9 except that chopped strand mat (F) was used in lieu of chopped strand mat (A). The results are shown in Table 2.

Since the wholly-aromatic polyester fiber constituting this chopped strand mat was originally yellow, the stamp-molded board presented a surface appearance indicating an intermingling of the whiteness of glass fiber and the yellowness of all-aromatic polyester fiber. However, there was no evidence of discoloration attributable to the heat applied in the sheet-forming step or in the stamp-molding process.

Example 16

A board was prepared by stamp-molding in the same manner as Example 8 except that chopped strand mat (G) was used in lieu of chopped strand mat (A). The results are shown in Table 2.

Since the carbon fiber constituting the chopped strand mat was originally black, the stamp-molded board presented a surface appearance indicating an intermingling of the whiteness of glass fiber and the blackness of carbon fiber. However, there was no evidence of discoloration attributable to the heat applied in the sheet-forming step or in the stamp-molding process.

Comparative Example 8

The procedure of Example 8 was repeated except that chopped strand mat (J) was used to give a board, which was then evaluated. The results are shown in Table 2.

Comparative Example 9

The procedure of Example 9 was repeated except that chopped strand mat (J) was used to give a board, which was then evaluated. The results are shown in Table 2.

Comparative Example 10

The procedure of Example 10 was repeated except that chopped strand mat (J) was used to give a board, which was then evaluated. The results are shown in Table 2.

Comparative Examples 11 to 16

Stamp-molded boards were prepared in the same manner as Example 8 except that chopped strand mats (H) (Comparative Example 11), (I) (Comparative Example 12), (K) (Comparative Example 13), (L) (Comparative Example 14), (M) (Comparative Example 15) and (N) (Comparative Example 16) were respectively used in lieu of chopped strand mat (A). These boards were evaluated. The results are shown in Table 2.

TABLE 2

| | Chopped strand mat | Yellowness of molded article [Y · I] | Tensile strength [kg/mm²] | Flexural strength [kg/mm²] | Flexural modulus [kg/mm²] | Notched Izod impact strength [kg/cm/cm] |
|---|---|---|---|---|---|---|
| Example 8 | A | 10.2 | 15.5 | 26.3 | 970 | 110 |
| Example 9 | A | 8.1 | 8.3 | 14.2 | 502 | 73 |
| Example 10 | A | 13.8 | 20.5 | 28.5 | 975 | 106 |
| Example 11 | B | 10.3 | 15.6 | 26.0 | 970 | 100 |
| Example 12 | C | 10.1 | 15.3 | 26.0 | 970 | 110 |
| Example 13 | D | 10.4 | 15.2 | 26.0 | 970 | 100 |
| Example 14 | E | 10.2 | 15.5 | 26.2 | 970 | 105 |
| Example 15 | F | — | 7.1 | 11.8 | 460 | 78 |
| Example 16 | G | — | 18.0 | 32.0 | 1850 | 80 |
| Comparative Example 8 | J | 17.4 | 12.1 | 21.0 | 800 | 80 |
| Comparative Example 9 | J | 15.5 | 7.5 | 12.1 | 430 | 65 |
| Comparative Example 10 | J | 22.6 | 17.4 | 23.2 | 824 | 83 |
| Comparative Exmaple 11 | H | 15.0 | 14.0 | 22.5 | 907 | 91 |
| Comparative Example 12 | I | 15.6 | 12.5 | 21.0 | 823 | 83 |
| Comparative Example 13 | K | 16.7 | 16.0 | 27.2 | 970 | 102 |
| Comparative Example 14 | L | 15.2 | 16.2 | 27.0 | 970 | 107 |
| Comparative Example 15 | M | 24.8 | 15.8 | 27.0 | 970 | 100 |
| Comparative Example 16 | N | 29.5 | 15.5 | 26.3 | 945 | 98 |

The results of macroscopic observation of the heat-treated chopped strand mats used in Examples 1 to 7 and Comparative Examples 1 to 7 (Table 1) were in good correlation with the yellowness indices (Y.I) of the corresponding stamp-molded thermoplastic sheets of Examples 8 to 14 and Comparative Examples 8 to 16 (Table 2). It should be understood that discolorations of Y.I= ≧14 for molded products are acceptable for the practical purpose.

Example 17

A colored board was prepared by stamp-molding in the same manner as Example 8 except that a colored polyethylene terephthalate resin sheet (0.4 wt. part of a gray pigment was added to 100 wt. part of polyethylene terephthalate) was used in lieu of the pigment-free polyethylene terephthalate resin sheet. Macroscopically examined, this colored board was attractive in appearance.

Comparative Example 17

A colored board was prepared by stamp-molding in the same manner as Example 8 except that chopped strand mat (J) was used in lieu of chopped strand mat (A) and a colored polyethylene terephthalate resin sheet (0.4 wt. part of a gray pigment was added to 100 wt. parts of polyethylene terephthalate) was used in lieu of the pigment-free polyethylene terephthalate resin sheet.

Macroscopic observation of this colored board revealed a distinct pattern of glass strand, with the discoloration along the glass fibers giving an unsettled overall appearance to the product board.

What is claimed is:

1. A chopped strand mat comprising chopped strands having fiber lengths of 10 to 100 mm and doped with a surface treating composition containing 0.05 to 2.0 weight percent of an epoxysilane coupling agent and 0.2 to 2.0 weight percent of an epoxy resin and, bound with 0.5 to 10 weight percent of a mat binder of a polymer containing an acrylic ester unit.

2. The chopped strand mat of claim 1 wherein said chopped strands are made of at least one member selected from the group consisting of glass fiber, wholly aromatic polyester fiber and carbon fiber.

3. The chopped strand mat of claim 1 or 2 wherein said polymer is a polymer of at least one monomer selected from the group consisting of acrylic acid esters and methacrylic acid esters.

4. A thermoplastic sheet comprising 15 to 60 weight percent of a chopped strand mat impregnated with a thermoplastic resin, said chopped strand mat comprising chopped strands having fiber lengths of 10 to 100 mm and doped with a surface treating composition containing 0.05 to 2.0 weight percent of an epoxysilane coupling agent and 0.2 to 2.0 weight percent of an epoxy resin and, bound with 0.5 to 10 weight percent of a mat binder of a polymer containing an acrylic ester unit.

5. The thermoplastic sheet of claim 4 wherein said thermoplastic resin is at least one member selected from the group consisting of polyolefin resin, polyester resin, polyamide resin, polyethersulphone resin and polycarbonate resin.

6. The thermoplastic sheet of claim 4 or 5 wherein said thermoplastic resin is polyolefin resin.

7. The thermoplastic sheet of claim 6 wherein said polyolefin resin is polypropylene.

8. The thermoplastic sheet of claim 4 or 5 wherein said thermoplastic resin is polyester resin.

9. The thermoplastic sheet of claim 8 wherein said polyester resin is polyethylene terephthalate.

10. The thermoplastic sheet of claim 4 for stamp-molding.

* * * * *